US008847055B2

(12) United States Patent
Rowe

(10) Patent No.: US 8,847,055 B2
(45) Date of Patent: Sep. 30, 2014

(54) METHOD AND APPARATUS FOR EXPLORING CHORD PROGRESSIONS WITHIN A DIATONIC MAJOR KEY

(76) Inventor: John Pasco Rowe, McKinney, TX (US)

( * ) Notice: Subject to any disclaimer, the term of this patent is extended or adjusted under 35 U.S.C. 154(b) by 111 days.

(21) Appl. No.: 13/493,818

(22) Filed: Jun. 11, 2012

(65) Prior Publication Data

US 2013/0192447 A1 Aug. 1, 2013

Related U.S. Application Data

(60) Provisional application No. 61/632,666, filed on Jan. 27, 2012.

(51) Int. Cl.
*G10H 1/38* (2006.01)

(52) U.S. Cl.
USPC ..... 84/613; 84/609; 84/637; 84/649; 84/650; 84/669

(58) Field of Classification Search
None
See application file for complete search history.

(56) References Cited

U.S. PATENT DOCUMENTS

| | | | | |
|---|---|---|---|---|
| 6,175,069 | B1 * | 1/2001 | Longacre | 84/476 |
| 7,396,988 | B1 * | 7/2008 | Rowe | 84/476 |
| 7,687,702 | B2 * | 3/2010 | Chu | 84/476 |
| 2009/0031880 | A1 * | 2/2009 | Chu | 84/476 |
| 2011/0031692 | A1 * | 2/2011 | Siegel | 273/268 |

* cited by examiner

*Primary Examiner* — Marlon Fletcher

(57) ABSTRACT

A method for obtaining a chord progression based upon a diatonic major key may include the steps of casting a dodecahedron to determine the diatonic major key, casting a octahedron to determine a chord based upon the diatonic major key and casting a cube to determine a playing strategy for the chord.

8 Claims, 6 Drawing Sheets

| Octahedrons | Number of octahedrons | Indicia | | | | | | | |
|---|---|---|---|---|---|---|---|---|---|
| | | side 1 | side 2 | side 3 | side 4 | side 5 | side 6 | side 7 | side 8 |
| O1 | 5 | C | Dm | Em | F | G | Am | B° | logo |
| O2 | 5 | G | Am | Bm | C | D | Em | F♯° | logo |
| O3 | 5 | D | Em | F♯m | G | A | Bm | C♯° | logo |
| O4 | 5 | A | Bm | C♯m | D | E | F♯m | G♯° | logo |
| O5 | 5 | E | F♯m | G♯m | A | B | C♯m | D♯° | logo |
| O6 | 5 | B | C♯m | D♯m | E | F♯ | G♯m | A♯° | logo |
| O7 | 5 | F♯ | G♯m | A♯m | B | C♯ | D♯m | E♯° | logo |
| | | G♭ | A♭m | B♭m | C♭ | D♭ | E♭m | F° | |
| O8 | 5 | D♭ | E♭m | F♭m | G♭ | A♭ | B♭m | C° | logo |
| O9 | 5 | A♭ | B♭m | Cm | D♭ | E♭ | Fm | G° | logo |
| O10 | 5 | E♭ | Fm | Gm | A♭ | B♭ | Cm | D° | logo |
| O11 | 5 | B♭ | Cm | Dm | E♭ | F | Gm | A° | logo |
| O12 | 5 | F | Gm | Am | B♭ | C | Dm | E° | logo |

| Octahedrons | Number of octahedrons | Indicia | | | | | | | |
|---|---|---|---|---|---|---|---|---|---|
| | | side 1 | side 2 | side 3 | side 4 | side 5 | side 6 | side 7 | side 8 |
| O1 | 5 | C | Dm | Em | F | G | Am | B° | logo |
| O2 | 5 | G | Am | Bm | C | D | Em | F♯° | logo |
| O3 | 5 | D | Em | F♯m | G | A | Bm | C♯° | logo |
| O4 | 5 | A | Bm | C♯m | D | E | F♯m | G♯° | logo |
| O5 | 5 | E | F♯m | G♯m | A | B | C♯m | D♯° | logo |
| O6 | 5 | B | C♯m | D♯m | E | F♯ | G♯m | A♯° | logo |
| O7 | 5 | F♯ | G♯m | A♯m | B | C♯ | D♯m | E♯° | logo |
| | | G♭ | A♭m | B♭m | C♭ | D♭ | E♭m | F° | |
| O8 | 5 | D♭ | E♭m | F♭m | G♭ | A♭ | B♭m | C° | logo |
| O9 | 5 | A♭ | B♭m | Cm | D♭ | E♭ | Fm | G° | logo |
| O10 | 5 | E♭ | Fm | Gm | A♭ | B♭ | Cm | D° | logo |
| O11 | 5 | B♭ | Cm | Dm | E♭ | F | Gm | A° | logo |
| O12 | 5 | F | Gm | Am | B♭ | C | Dm | E° | logo |

Figure 1

| Side | Indicia |
|---|---|
| 1 | C major |
| 2 | G major |
| 3 | D major |
| 4 | A major |
| 5 | E major |
| 6 | B major |
| 7 | F♯ major |
| | G♭ major |
| 8 | D♭ major |
| 9 | A♭ major |
| 10 | E♭ major |
| 11 | B♭ major |
| 12 | F major |

Figure 2

| Side | Indicia |
|---|---|
| 1 | n v |
| 2 | n – |
| 3 | – v |
| 4 | – – |
| 5 | 3<br>n v n |
| 6 | 4<br>n v n v |

Figure 3

METHOD AND APPARATUS FOR EXPLORING CHORD PROGRESSIONS WITHIN A DIATONIC MAJOR KEY

PRIORITY

The present invention claims priority under 35 USC section 119 based upon a provisional application filed on and with a Ser. No. 61/632,666.

FIELD OF THE INVENTION

The instant invention relates generally to a game and more specifically it relates to a music composition method which provides a plurality of playing octahedrons, a dodecahedron and a cube. Additionally, the present invention includes a strategy for choosing a strumming and rhythm pattern for a musical instrument.

BACKGROUND

U.S. Pat. No. 7,396,988 which is incorporated by reference in its entirety discloses a music composition method and apparatus including a plurality of small playing cubes each having a color-coded musical chord with a number to indicate the position of the chord within the matching color-coded musical key of a separate, larger cube indicated on each side thereof. A color-coded device is provided to guide the placement of playing cubes into sequences of chord progressions thereon after the playing cubes are cast upon a flat surface. A player can form multiple chord progressions from the chords on the top sides of the cast playing cubes and play the cast sequence of chords on their instrument thereby learning the relationship between the chords belonging to a musical key.

SUMMARY

A method for obtaining a chord progression based upon a diatonic major key may include the steps of casting a dodecahedron to determine the diatonic major key, casting a octahedron to determine a chord based upon the diatonic major key and casting a cube to determine a playing strategy for the chord.

The method may include the step of casting the octahedron includes the step of casting the octahedron multiple times in order to determine a chord progression.

The strategy may be used to play the chord progression.

The playing strategy may include a downbeat.

The playing strategy may include an upbeat.

The playing strategy may include a rest.

The playing strategy may include a rhythm pattern.

The diatonic major key may include a scale step.

The diatonic major key may include a chord formed by the scale step.

BRIEF DESCRIPTION OF THE DRAWINGS

The invention may be understood by reference to the following description taken in conjunction with the accompanying drawings, in which, like reference numerals identify like elements, and in which:

FIG. 1 illustrates a table corresponding to the use of a octahedron of the present invention;

FIG. 2 illustrates a table corresponding to the use of a dodecahedron of the present invention;

FIG. 3 illustrates a table corresponding to the use of a cube of the present invention;

DETAILED DESCRIPTION

Figure 9:
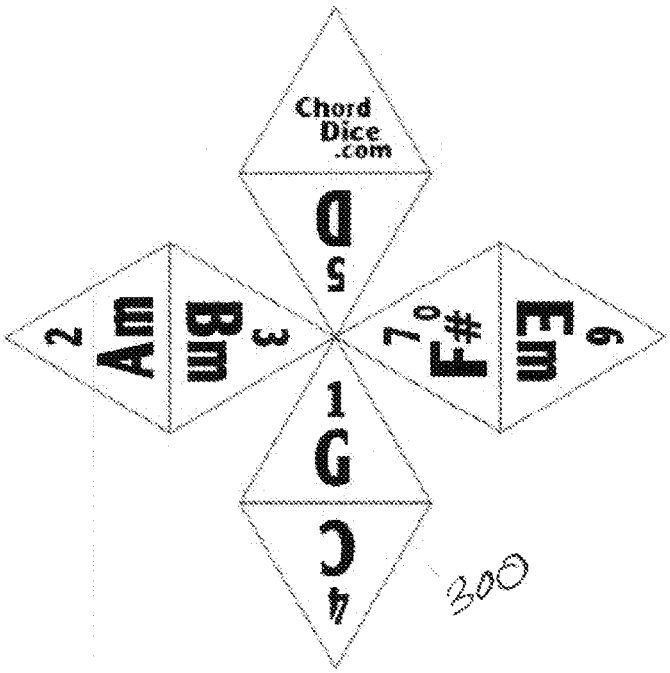
FIG. 9 illustrates the faces of the octahedron of the present invention.

The game of the present invention may be played by one person but two or more participants are always better; however, this invention does not necessarily promote competition between players. This invention is intended to inspire and promote learning and creativity with a musical instrument.

The game of the present invention includes a multitude of octahedrons for example 12 (other numbers of octahedrons are within the scope of the invention), a dodecahedron, a cube and a strategy for choosing a strumming and rhythm pattern for a musical instrument which may be a guitar or banjo.

Each of the octahedrons may include 8 sides, and each side may include a scale step and its corresponding chord within a diatonic major key (one side may include a logo). The first side of the first octahedron may correspond to the scale steps and chords of the diatonic key of C major, the second octahedron may correspond to the scale steps and chords of the diatonic key of G major, the first side of the third octahedron may correspond to the scale steps and chords of the diatonic key of D major, the first side of the fourth octahedron may correspond to the scale steps and chords of the diatonic key of A major, the first side of the fifth octahedron may correspond to the scale steps and chords of the diatonic key of E major, the first side of the sixth octahedron may correspond to the scale steps and chords of the diatonic key of B major, the first side of the seventh octahedron may correspond to the scale steps and chords of the diatonic key of F# (F sharp) major and Gb (G Flat) major, the first side of the eighth octahedron may correspond to the scale steps and chords of the diatonic key of Db (D flat), the first side of the ninth octahedron may correspond to the scale steps and chords of the diatonic key of Ab major, the first side of the tenth octahedron may correspond to the scale steps and chords of the diatonic key of Eb major, the first side of the eleventh octahedron may correspond to the scale steps and chords of the diatonic key of Bb major and the first side of the twelfth octahedron may correspond to the scale steps and chords of the diatonic key of F major.

FIG. 1 illustrates a table which corresponds to a summary of the scale steps and chords of the diatonic key where each row of the first table corresponds to a different octahedron and the columns correspond to the side of the octahedron.

An example of the detailed description about the 8 sides of each octahedron follows.

Side 1 of each octahedron may correspond to the 1st scale step (as indicated by the '1' indicia) and its corresponding chord within the diatonic major key which may be determined by the 1st scale step.

Side 2 of each octahedron may correspond to the 2nd scale step (as indicated by the '2' indicia) and its corresponding chord within the diatonic major key which may be determined by the 1st scale step.

Side 3 of each octahedron may correspond to the 3rd scale step (as indicated by the '3' indicia) and its corresponding chord within the diatonic major key which is determined by the 1st scale step.

Side 4 of each octahedron may correspond to the 4th scale step (as indicated by the '4' indicia) and its corresponding chord within the diatonic major key which may be determined by the 1st scale step.

Side 5 of each octahedron may correspond to the 5th scale step (as indicated by the '5' indicia) and its corresponding chord within the diatonic major key which may be determined by the 1st scale step.

Side 6 of each octahedron may correspond to the 6th scale step (as indicated by the '6' indicia) and its corresponding chord within the diatonic major key which may be determined by the 1st scale step.

Side 7 of each octahedron may correspond to the 7th scale step (as indicated by the '7' indicia) and its corresponding chord within the diatonic major key which may be determined by the 1st scale step.

Side 8 of each octahedron may correspond to a wild card that can be re-rolled or when the wild card is cast it can be removed from the chord progression or the wild card can act as silence in the song.

FIG. 2 illustrates the 12 sides of the dodecahedron which illustrates the corresponding diatonic major key.

The player throws the dodecahedron and the side facing up determines the diatonic major key. If the second side comes up then the steps and chords of the diatonic key of G major is to be used by the player. More particularly, the side of the dodecahedron facing up determines the row in the first table. The row additionally indicates the number of times that a selected octahedron is to be cast, and each time a octahedron is cast the scale steps of the major key is selected for the player. Row 2 indicates that the selected octahedron is to be cast five times. The first cast of the octahedron comes up side 1 to indicate that the player plays G; the second cast of the octahedron comes up side 4 to indicate the player plays C; the third cast of the octahedron comes up side 5 to indicate that the player plays D; the fourth cast of the octahedron comes up side 6 to indicate that the player plays Em (E minor); and the fifth cast of the octahedron comes up side 5 to indicate that the player plays D.

Other rows include F# to indicate that F sharp should be played by the player, and E° to indicate E diminished should be played, and Dm to indicate that D minor should be played.

Each side of the octahedron may include indicia which corresponds to the scale step of the major key and a multitude of chords formed by the scale step.

In summary, the player throws the dodecahedron to determine the diatonic major key and the player next throws the octahedron corresponding to the selected diatonic major key to select a first chord. The player throws the octahedron the number of times corresponding to the number of octahedrons indicated in the table of FIG. 1. This determines the chord progression.

Each octahedron may be color-coded to facilitate fast and easy recognition of the octahedron.

Next the player obtains a strategy for choosing a strumming and rhythm pattern which may be required to cast as many cubes as desired. The strategy is obtained by casting a specially marked cube. FIG. 3 illustrates the cube sides where 'n' is a downbeat, 'v' is an upbeat and '-' is a rest or miss on the guitar strings.

In an example, the musician may cast six cubes. The results are that the musician casts a side 1, a side 2, a side 3, a side 4, a side 5, and a side 6. Using a common chord, the player would strum the chord as follows:

Down/up (side 1)/down/Miss (side 2)/Miss/up (side 3)/Miss/Miss (side 4)/triple strum (down/up/down) (side 5) and/quadruple strum (down/up/down/up) (side 6).

Figure 4:
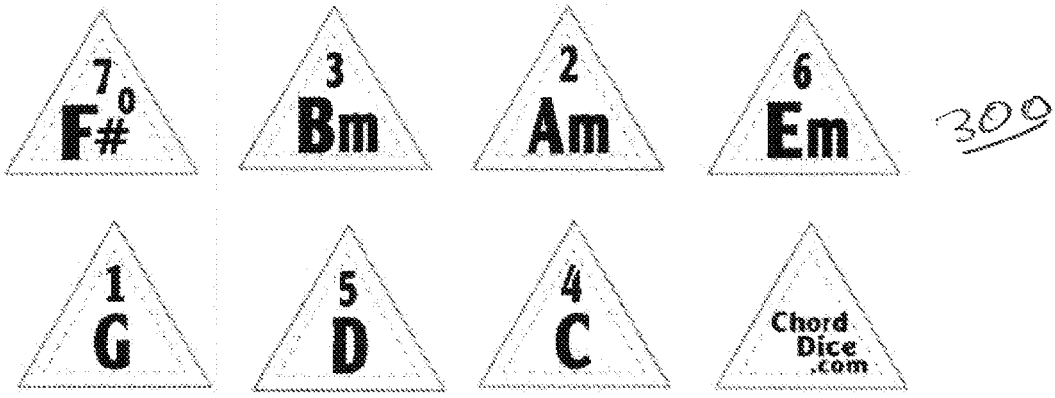
FIG. 4 illustrates the faces of the octahedron of the present invention.
Figure 5:
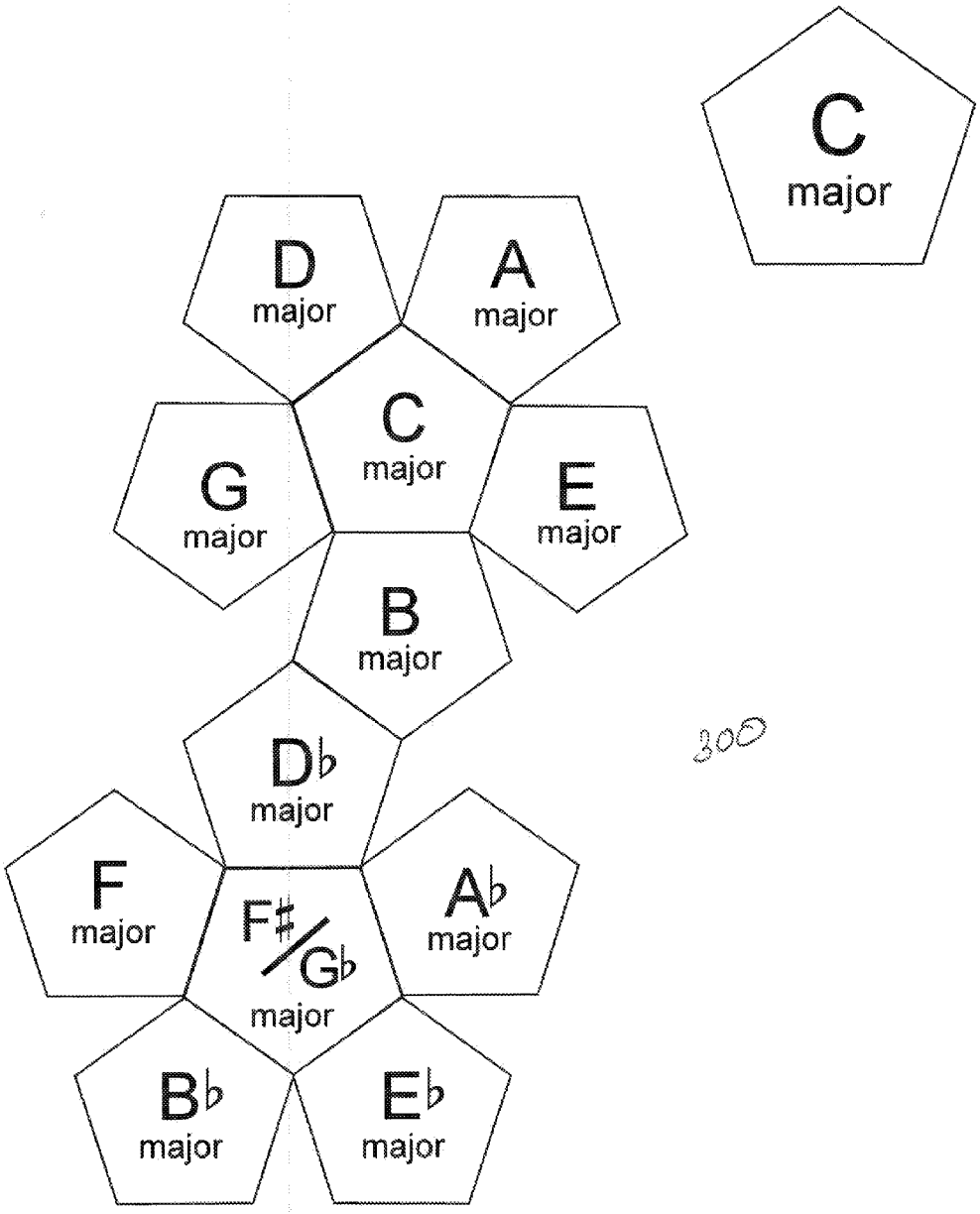
FIG. 5 illustrates the faces of the dodecahedron of the present invention.
Figure 6:
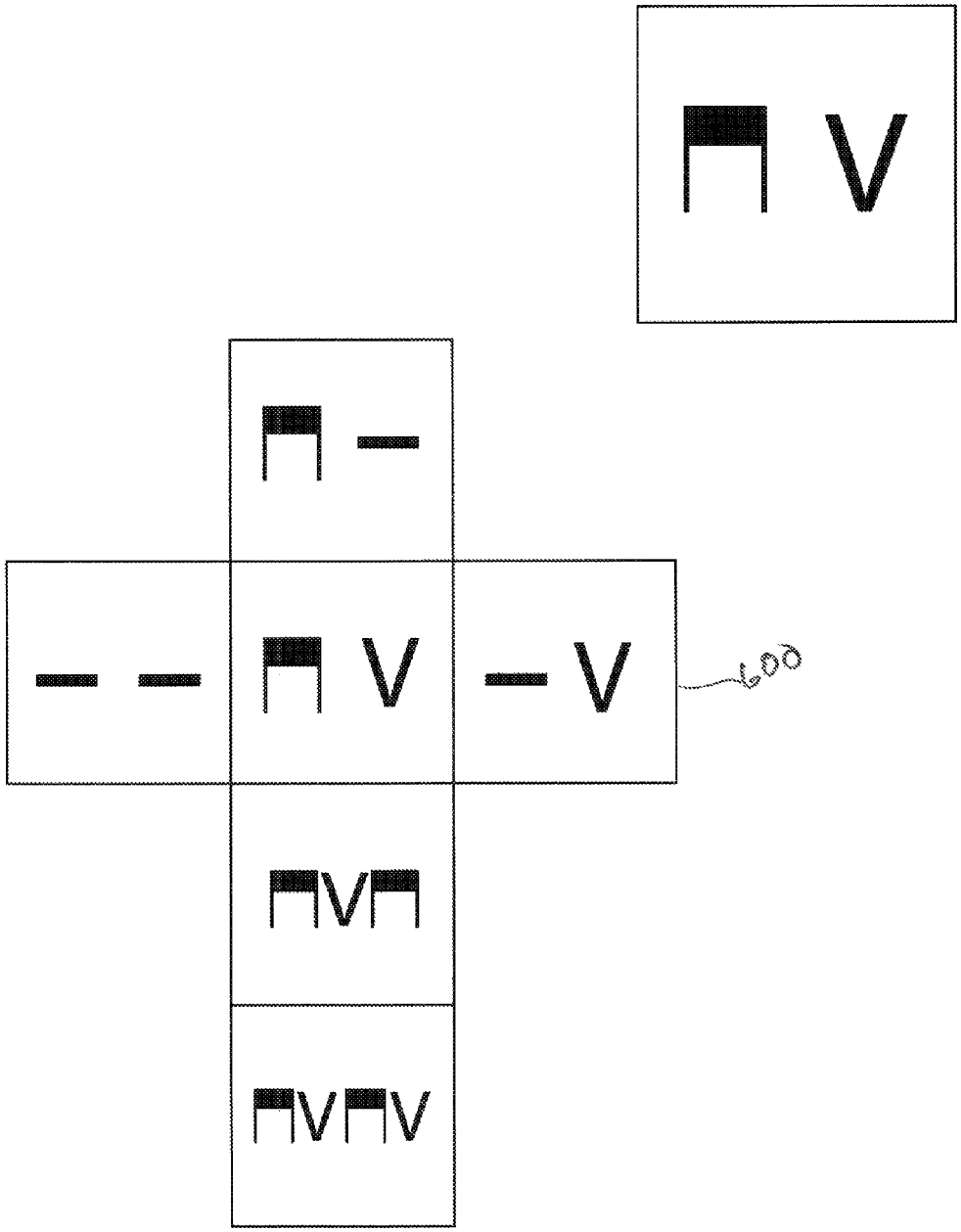
FIG. 6 illustrates the faces of the cube of the present invention.

FIG. 3 illustrates a table corresponding to the use of a cube of the present invention;

FIGS. 4 and 9 illustrates the faces of the octahedron 300 of the present invention;

FIG. 5 illustrates the faces of the dodecahedron 300 of the present invention;

FIG. 6 illustrates the faces of the cube 600 of the present invention.

Figure 7:
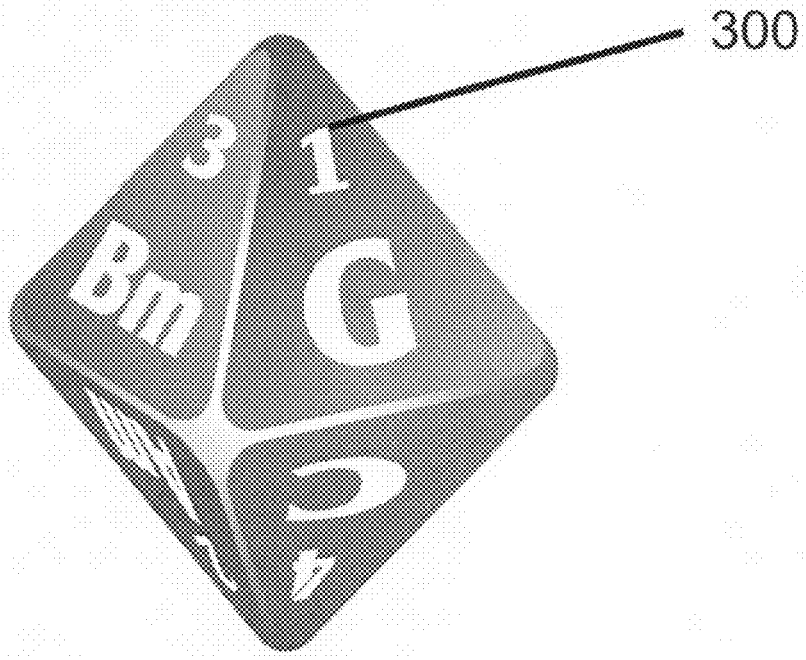
FIG. 7 illustrates a perspective view of the dodecahedron of the present invention.
Figure 8:
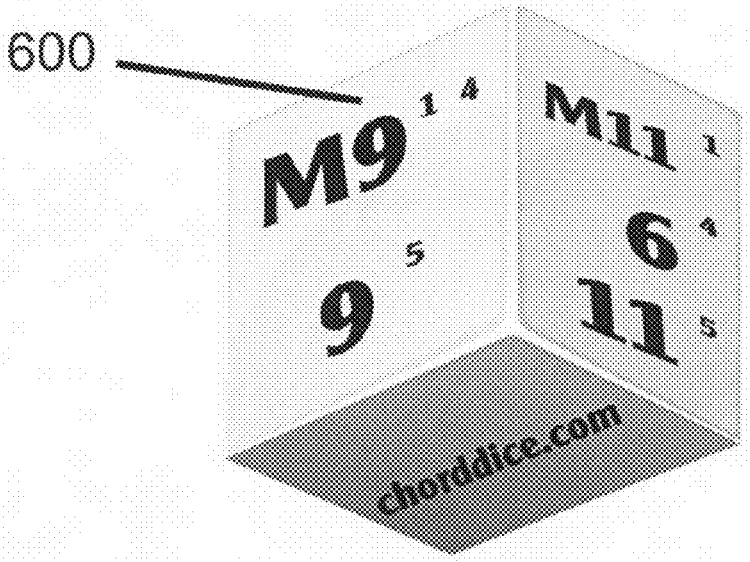
FIG. 8 illustrates a perspective view of the cube of the present invention.

FIG. 7 illustrates a perspective view of the dodecahedron 300 of the present invention;

FIG. 8 illustrates a perspective view of the cube 600 of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A method for obtaining a chord progression based upon a diatonic major key, comprising the steps of:

casting a dodecahedron to determine the diatonic major key;

casting a octahedron to determine a chord based upon the diatonic major key; and casting a cube to determine a playing strategy for the chord;

obtaining the chord progression from the results of the casting;

wherein the playing strategy includes a downbeat.

2. A method for obtaining a chord progression based upon a diatonic major key, comprising the steps of:

casting a dodecahedron to determine the diatonic major key;

casting a octahedron to determine a chord based upon the diatonic major key; and casting a cube to determine a playing strategy for the chord;

obtaining the chord progression from the results of the casting;

wherein the playing strategy includes an upbeat.

3. A method for obtaining a chord progression based upon a diatonic major key, comprising the steps of:

casting a dodecahedron to determine the diatonic major key;

casting a octahedron to determine a chord based upon the diatonic major key; and casting a cube to determine a playing strategy for the chord;

obtaining the chord progression from the results of the casting;

wherein the playing strategy includes a rest.

4. A method for obtaining a chord progression based upon a diatonic major key as in claim 3, wherein the step of casting the octahedron includes the step of casting the octahedron multiple times in order to determine a chord progression.

5. A method for obtaining a chord progression based upon a diatonic major key as in claim 4, wherein the strategy is used to play the chord progression.

6. A method for obtaining a chord progression based upon a diatonic major key as in claim 3, wherein the playing strategy includes a rhythm pattern.

7. A method for obtaining a chord progression based upon a diatonic major key as in claim 3, wherein the diatonic major key includes a scale step.

8. A method for obtaining a chord progression based upon a diatonic major key as in claim 7, wherein the diatonic major key includes a chord formed by the scale step.

* * * * *